US005505651A

United States Patent [19]

Coughlin

[11] Patent Number: 5,505,651

[45] Date of Patent: Apr. 9, 1996

[54] DOLL DISPLAY AND SWING

[76] Inventor: Darrell W. Coughlin, P.O. Box 145, Batchtown, Ill. 62006

[21] Appl. No.: 378,519

[22] Filed: Jan. 26, 1995

[51] Int. Cl.[6] ..... A63H 3/00; A63H 3/18; A63H 3/52

[52] U.S. Cl. ..... 446/268; 446/322; 446/478; 446/73; 211/113; 108/149

[58] Field of Search ..... 108/149; 47/82, 47/83; 211/113, 115, 116, 118; 40/617; 446/268, 322, 323, 476, 478, 486, 487, 490, 72, 73, 74; 472/118, 125

[56] References Cited

U.S. PATENT DOCUMENTS

| | | | |
|---|---|---|---|
| 180,613 | 8/1876 | McCutchins | 446/268 |
| 725,207 | 4/1903 | Banderson | 211/115 |
| 1,078,729 | 11/1913 | Hill | 211/115 X |
| 1,227,723 | 5/1917 | Wilson | 108/149 |
| 1,391,153 | 9/1921 | Witte . | |
| 1,749,497 | 3/1930 | McGlashan | 47/83 X |
| 2,497,372 | 2/1950 | Pricer | 472/125 X |
| 2,580,920 | 1/1952 | Hunt . | |
| 2,860,689 | 11/1958 | Baker . | |
| 3,058,744 | 10/1962 | McGuire . | |
| 3,130,969 | 4/1964 | Groth . | |
| 3,279,428 | 10/1966 | Schad | 211/113 X |
| 3,528,657 | 9/1970 | Krupsky | 472/118 |
| 4,017,071 | 4/1977 | Wright . | |
| 4,122,782 | 10/1978 | Coombs | 108/149 X |
| 4,329,789 | 5/1982 | Erickson | 211/113 X |
| 4,903,846 | 2/1990 | Smith | 211/118 X |
| 5,161,522 | 11/1992 | Clevenger . | |

*Primary Examiner*—Mickey Yu
*Assistant Examiner*—D. Neal Muir
*Attorney, Agent, or Firm*—Polster, Lieder, Woodruff & Lucchesi

[57] ABSTRACT

A hangable, collapsible doll display which may also be used as a doll swing is provided. The doll display includes a generally circular top frame, at least two doll supporting levels below the top frame capable of supporting a doll, netting which collapsibly connects each of the levels of the display to each other and to the circular top frame, a conical section of netting above the top frame having an apex; and a ring secured to the apex to enable the display to be hung from a stand, ceiling, etc. The levels of the display may include seats in which dolls may sit, a solid platform on which dolls may sit or lie, a solid platform which will support the dolls in a standing position, or a mesh platform on which the dolls may lie. The seats used in the swing may be made in various sizes to accommodate various sized dolls. The seats of the swing are preferably removably mounted in a seat frame. A platform is positioned adjacent the seats to provide an area where doll accessories may be placed.

14 Claims, 2 Drawing Sheets

DOLL DISPLAY AND SWING

BACKGROUND OF THE APPLICATION

This invention relates to doll swings and displays.

Many small children play with dolls and may accumulate many dolls. Often, the dolls will be placed in a closet, a toy chest, or simply thrown in a comer of the room. It is desirable to have a display in which the dolls can be placed, so that the dolls can be neatly stored away, and so that the dolls can be displayed. Preferably, the doll display can also be used as a swing for the dolls contained therein, so that the child can play with the dolls in the display.

Many people also collect dolls and want to display then in an aesthetic manner.

SUMMARY OF THE INVENTION

One object of the present invention is to provide a doll display.

A second object is to provide such a display which may function as a swing.

A third object is to provide such a display which is aesthetically pleasing and which may be easily installed in a room.

A fourth object is to provide such a display which may accommodate dolls of various sizes.

A fifth object is to provide such a display which may accommodate dolls standing-up and/or sitting down.

These and other objects will become apparent to those skilled in the art in light of the following disclosure and accompanying drawings.

In accordance with the invention, generally stated, a doll display is provided which may also function as a swing. The display/swing is hangable from a ceiling, stand, etc. and includes a generally circular top frame; at least two doll supporting levels below the top frame capable of supporting a doll; netting which collapsibly connects each of the levels to each other and to the circular top frame. The netting defines walls for each level. An opening is thus formed at each level to allow access to each level. A conical section of netting is formed above the top frame and has an apex where a ring is secured to enable the display/swing to be hung. The levels on which the dolls are placed can take a variety of configurations. The levels can be a solid platform, a mesh platform, or a seat assembly having seats in which dolls can sit. The levels can all be different, or they may all be the same.

The seat assembly includes an outer ring which is secured to the netting and a seat frame fixed to the outer ring. The seat frame includes a back rod, two side rods, and a front rod which define a seat area. A flexible cloth seat is removably mounted in each seat area, such as by the use of snaps. A platform is positioned adjacent the seats to provide an area where doll accessories may be placed. The seat platform is, in one embodiment, an annular platform defining a central opening. The seat areas are formed within the central opening such that the annular platform surrounds the seats. In another embodiment, the platform is positioned inside of the seats.

The solid platform may include a post, to enable dolls to be supported in a standing position.

In another embodiment of the display, the display is provided with a lower conical netting section to which a ring is secured. The ring may be fixed to a surface or stand to prevent the display from swinging.

DESCRIPTION OF THE PREFERRED EMBODIMENT

Figure 1:
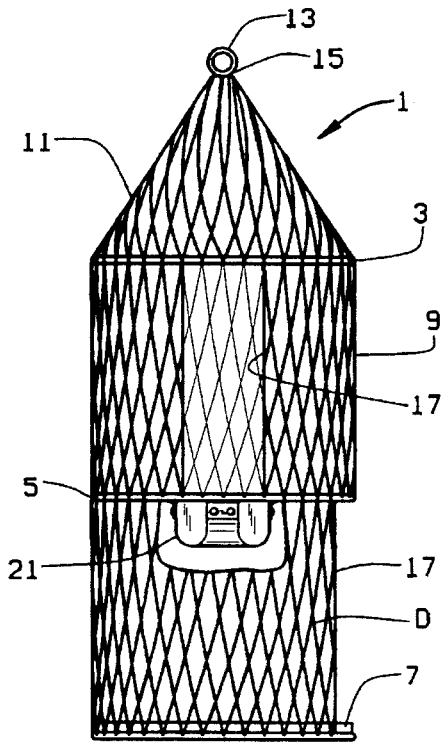
FIG. 1 is a side elevational view of a doll display of the present invention which may also function as a swing.

A doll display 1 of my invention is shown generally in FIG. 1. The display 1 includes a top, generally circular frame 3 and at least two levels 5 and 7 on which dolls can be placed. A netting 9 surrounds the levels 5 and 7 and the top frame 3 and serves to connect the three parts (i.e. the frame 3 and the levels 5 and 7). The netting is preferably a thread or rope netting, some what similar to that found in a fishing net and forms a plurality of generally diamond shaped areas D. The netting is very flexible, and thus the swing 1 may be collapsed upon itself. The netting continues above the frame 3 to form a cone 11. A ring 13 or rope loop is secured to the apex 15 of the cone. Using the ring, the display 1 may be suspended from a ceiling, hanger, stand, etc. The display 1 is not secured from its bottom. The display is thus free to swing from the line to which the ring 13 is connected. The display thus can also function as a swing for dolls.

The netting 9 defines a circular wall which surrounds each of the levels 5 and 7. An opening 17 is formed in the netting at each level so that dolls may be placed in, and removed from, each level. The openings 17 can be any shape, but are preferably generally rectangular and extend the full length between the levels. As can be seen, the openings for each level are offset from each other. The openings can be offset by any desired amount, but are preferably about 90° apart.

Figure 5:
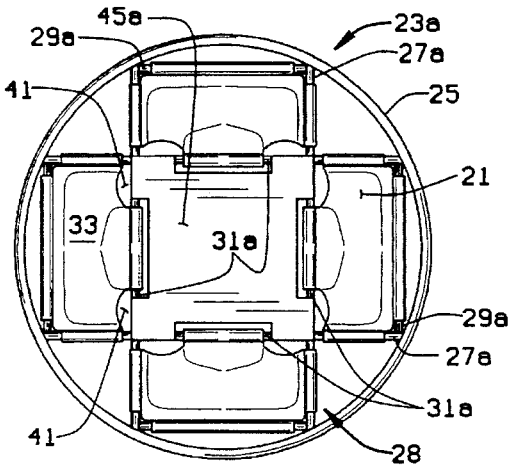
FIG. 5 is a top plan view of a seat frame used in conjunction with the swing/display showing a four-seat configuration.

The level 5 preferably includes seats 21 into which the dolls may be placed. The seats are suspended from a seat frame. The seat frame can take on a plurality of configurations. Four illustrative configurations are shown in FIGS. 5–8. The seat frame 23*a* (FIG. 5) includes a circular outer frame 25 which is knotted to the netting to secure the seat frame to the netting. Two sets of rods 27*a* extend across the frame 27 to divide the frame into thirds both vertically and horizontally, as seen in FIG. 5, to form seat side supports. The rods are connected by back members 29*a* and front members 31*a*, and in combination define four equally spaced and sized seat areas 28 in which the seats 21 are placed.

Figure 3:
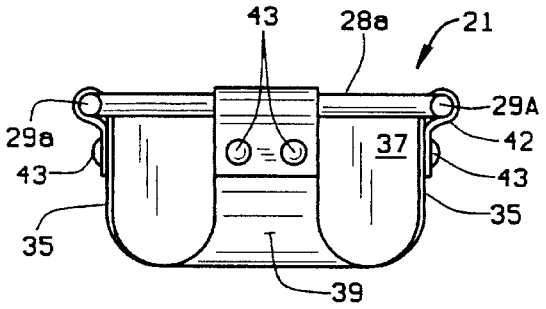
FIG. 3 is a front elevational view of a seat used in conjunction with the swing/display of FIGS. 1 and 2.
Figure 4:
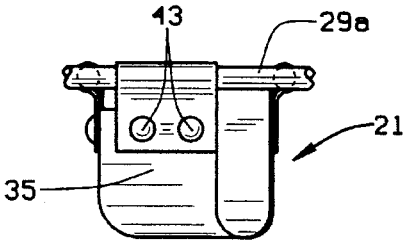
FIG. 4 is a side elevational view of the seat.

Each seat 21 is preferably made of one piece of flexible cloth which is snapped over the various members to define the seat, as best seen in FIGS. 3 and 4. The seats each have a bottom 33 from which sides 35 and backs 37 extend upwardly to the members 29*a* and 27*a*. A crotch piece 39 extends up from the front of the seat bottom 33 to define leg holes 41. The back, sides, and crotch pieces all have extra lengths of cloth 42 to which snaps 43 are connected. The lengths of cloth 42 extend over the seat frame members so that the seats 21 may be removably secured to the seat frame. The seats may thus be removed for washing or replacing. Although snaps are preferred, because they are easier to work with, buttons or other fasteners which allow the seat to be removed from the frame may be used in place of the snaps.

A surface 45*a* is mounted over the members 29*a* and 27*a* in the center of the seat frame. Surface 45*a* is shown in FIG. 5 to be generally square, however, it may also be round or any other desired shape. When the swing 1 is not being swung, surface 45*a* serves as an area where doll accessories may be placed.

Figure 6:
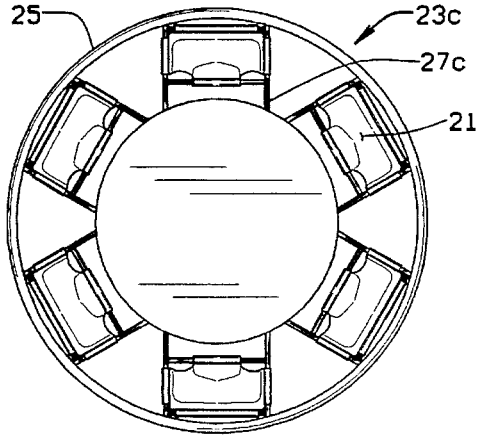
FIG. 6 is a top plan view of a seat frame used in conjunction with the swing/display showing a six-seat configuration.

A seat second frame 23*b* is shown in FIG. 6. Seat frame 23*b* is substantially similar to seat frame 23*a*. However, rather than having surface 45*b* located in the center of the swing, surface 25*b* is generally annular in shape and is positioned just inside of ring 25. Further, seats 21 are mounted so that they face outwardly, rather than inwardly, as in seat frame 23*a*. In seat frame 23*a*, the seats 21 are substantially adjacent ring 25. Because annular surface 45*b* is adjacent the ring 25 in seat frame 23*b*, extension bars 47 are provided for members 27*b* so that the seats 21 may be mounted inside of annular surface 45*b*.

Figure 7:
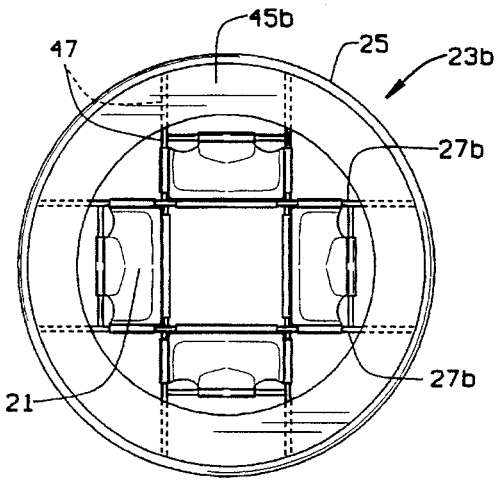
FIG. 7 is a view similar to FIG. 5 showing a different configuration of the four-seat frame.
Figure 8:
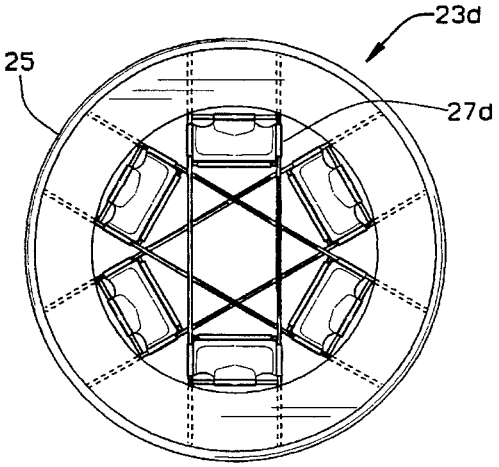
FIG. 8 is a view similar to FIG. 6 showing a different configuration of the six-seat frame.

Seat frames 23*a* and 23*b* provide four seats and fit larger dolls. Frames 23*c* and 23*d*, shown in FIGS. 7 and 8, provide six seats 21. Seat frames 23*c* and 23*d* are substantially similar to seat frames 23*a* and 23*b*, respectively, and differ only in the positioning of the side members 27*c* and 27*d* which form the side members for the seats. The seats 21 for frames 23*c* and 23*d* are identical in construction to that of the seats for frames 23*a* and 23*b*. However, these seats are smaller, to fit in the smaller seat areas.

Figure 9:
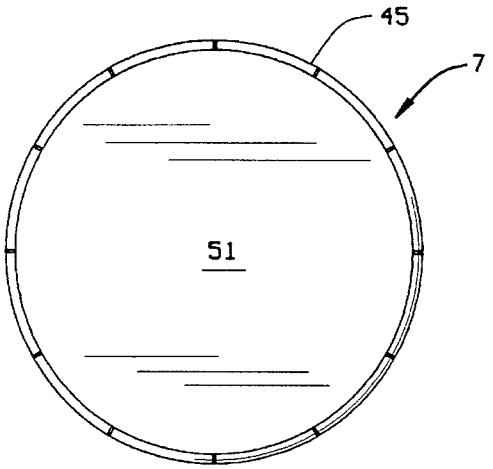
FIG. 9 is a plan view of a solid platform used in conjunction with the swing/display to support dolls in a standing position.

Turning back to FIG. 1, the bottom level is preferably solid and does not include seats. The bottom level defines a surface where doll accessories may be placed. Level 7, like level 5, however, includes an outer ring 45 (FIG. 9) which is spaced from its surface 51 and which allows level 7 to be knotted or otherwise secured to the netting 9. The distance between level 5 and level 7 is preferably equal to the distance between top frame 3 and level 5.

Figure 2:
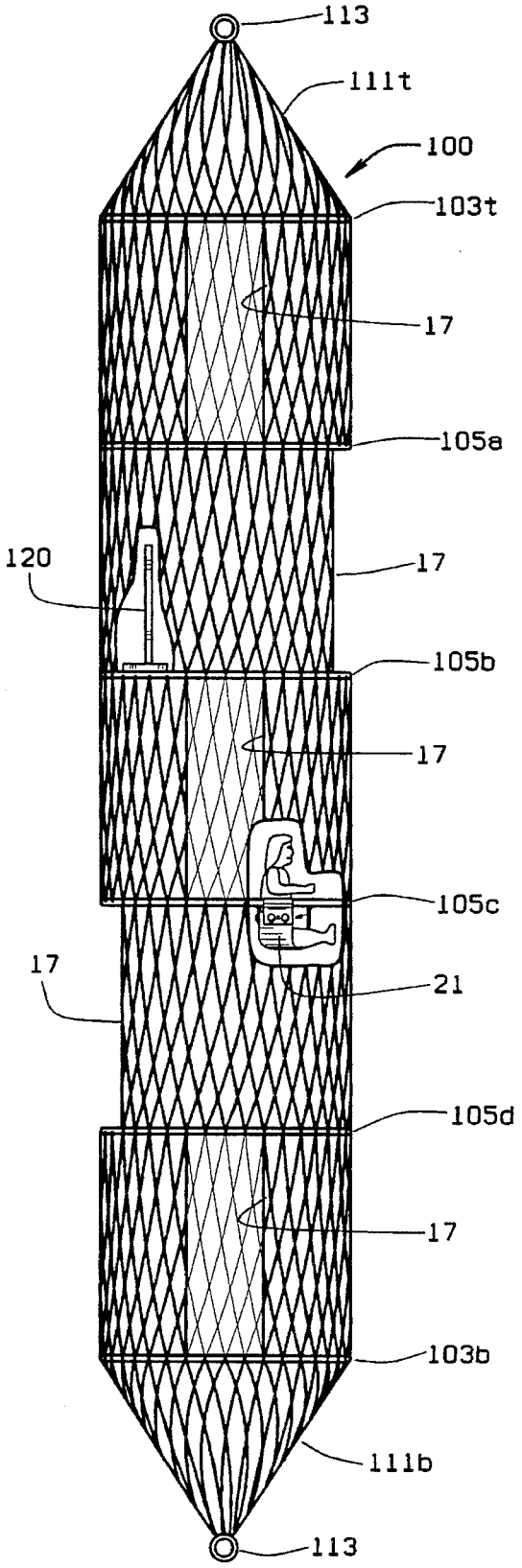
FIG. 2 is a side elevational view of a second embodiment of the doll display.

A second embodiment 100 of my doll display is shown in FIG. 2. Display 100 is substantially similar to the display/swing 1. However, it has several levels 105*a–d*, all of which are equally spaced. It has a top frame 103*t* and a bottom frame 103*b*, from which netting cones 111*t* and 111*b* are formed. Each cone has a ring 113 at its apex. This allows the swing/display to be suspended from above and secured from below to prevent the display from swinging.

Figure 10:
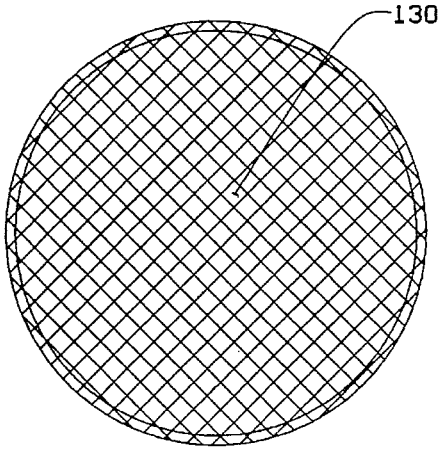
FIG. 10 is a plan view of a net platform used in conjunction the swing/display.

Levels 105*a–d*, may take on a variety of configurations. They can include seats, such as seat frame 23*a*–23*d* so that dolls may be displayed in a sitting position. They may also be flat surfaces, such as level 7 of display/swing 1. Dolls can be positioned either laying down or sitting on such a surface. Further, the levels could have a solid surface and a support post 120, as shown at level 105*b*, to support dolls in a standing position. The level could also be a soft level, such as shown in FIG. 10 which includes a netted surface 130 secured to a frame 131. The levels 105*a–d*, again are preferably equally spaced apart. They may all be the same, or different types of levels may be used in a single display.

As variations within the scope of the appended claims may be apparent to those skilled in the art, the foregoing description is set forth only for illustrative purposes and is not meant to be limiting. The foregoing description is thus set forth for illustrative purposes only, and is not intended to be limiting.

I claim:

1. A hangable, collapsible doll display including:

a generally circular top frame;

at least two doll supporting levels below said top frame capable of supporting a doll;

netting which collapsibly connects each of said at least two levels to each other and to said circular top frame, said netting forming a wall for each level, said netting having an opening at each level to enable dolls to be placed at each level, said opening being a vertical opening extending the height of each level, the opening of one level being off-set from the opening of an adjacent level;

a conical section of netting above said top frame having an apex; and a ring secured to said apex to enable said display to be hung;

each of said at least two doll supporting levels being chosen from a group consisting of a seat assembly having seats in which dolls may sit, a solid platform, and a mesh platform;

wherein said seat assembly includes:

an outer ring which is secured to the netting;

a seat frame fixed to said outer ring, said seat frame including a back rod, two side rods, and a front rod, said rods defining a seat area;

a flexible seat removably mounted in each seat area; said seat including a back portion removably secured to the back rod and extending substantially the length of the back rod to define a back of the seat, two side portions removably connected to the side rods and extending substantially the length of said side rods, a front portion removable connected to said front rod and positioned generally in a center of said front rod to define leg openings, and a seat bottom connected to said side, back, and from portions; said seat being a one-piece seat made from a single piece of material.

2. The doll display of claim 1 wherein said seat assembly includes a seat platform, said seat platform being an annular platform defining a central opening, said seat frame being positioned within said central opening such that said annular platform surrounds said seats, said seat frame including extension rods extending from said seat frame to said outer ring to fix said seat frame to said outer ring, said seat platform sitting on said extension rods.

3. The doll display of claim 1 wherein said seat assembly includes a seat platform, said seats being fixed directly to said outer ring and define a central area, said seat platform being a solid platform mounted in said central area; said seat frame defining a support for said solid platform on which said platform sits.

4. The doll display of claim 1 wherein said leg openings face inwardly.

5. The doll display of claim 1 wherein said leg openings face outwardly.

6. The doll display of claim 1 wherein said platform includes supports for supporting said dolls in a standing position, said platform including an outer frame secured to said netting and a platform secured to said outer frame.

7. The doll display of claim 1 wherein said mesh platform includes an outer frame secured to said netting and a mesh mounted to said outer frame.

8. The doll display of claim 1 wherein said display is generally cylindrical.

9. The doll display of claim 1 including a lower conical netting section, said lower conical netting section defining a bottom apex having a ring to facilitate securing said display against swinging motion.

10. The doll of claim 9 wherein said doll display lower conical section depends from a lowermost one of said at least two levels.

11. The doll display of claim 9 wherein said doll display includes a bottom circular frame, said lower conical section depending from said bottom circular fade, said lower conical section being securable to a fixture.

12. A hangable, collapsible doll swing including:

a generally circular top frame;

at least two generally horizontal doll supporting levels below said top frame capable of supporting a doll;

netting which collapsibly connects each of said at least two levels to each other and to said circular top frame;

a conical section of netting above said top frame having an apex; and a ring secured to said apex to enable said display to be hung;

at least one of said at least two levels including a generally horizontal seat assembly in which dolls may be placed; said seat assembly including an outer ring which is secured to the netting; a plurality of intersecting rods forming a generally horizontal seat frame mounted to said outer ring, said seat frame defining a plurality of seat areas with a plurality of flexible seats attached between adjacent rods; and each seat is mounted in a seat area to depend from said rods.

13. The doll swing of claim 12 wherein said seat is removably mounted in said seat frame, said seat including a back portion removably secured to a rod and extending to define a back of the seat, two side portions removably connected to rods, a front portion removably connected to a rod and positioned generally to define leg holes, and a seat bottom connected to said side, back, and front portions; said seat being a one-piece seat made from a single piece of cloth, said leg holes and said seat bottom being below said bars.

14. The doll swing of claim 12 wherein said seat assembly includes a platform adjacent said seats.

* * * * *

UNITED STATES PATENT AND TRADEMARK OFFICE

CERTIFICATE OF CORRECTION

PATENT NO. : 5,505,651
DATED : April 9, 1996
INVENTOR(S) : Darrell W. Coughlin

It is certified that error appears in the above-indentified patent and that said Letters Patent is hereby corrected as shown below:

Claim 11, Col. 5, line 17, the word "fade" should be ---frame---.

Signed and Sealed this

Eighteenth Day of November 1997

*Attest:*

Bruce Lehman

BRUCE LEHMAN

*Attesting Officer*

*Commissioner of Patents and Trademarks*